US007123209B1

(12) United States Patent
Desclos et al.

(10) Patent No.: US 7,123,209 B1
(45) Date of Patent: Oct. 17, 2006

(54) LOW-PROFILE, MULTI-FREQUENCY, DIFFERENTIAL ANTENNA STRUCTURES

(75) Inventors: Laurent Desclos, San Diego, CA (US); Gregory Poilasne, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 10/376,109

(22) Filed: Feb. 26, 2003

(51) Int. Cl.
*H01Q 1/50* (2006.01)

(52) U.S. Cl. ..... 343/860; 343/850

(58) Field of Classification Search ..... 343/850, 343/859, 860

See application file for complete search history.

(56) References Cited

U.S. PATENT DOCUMENTS 3,541,555 A * 11/1970 Willie et al. ..... 343/720
3,721,990 A 3/1973 Gibson et al.
3,955,146 A * 5/1976 Brennan ..... 330/255
4,450,449 A 5/1984 Jewitt
4,598,276 A 7/1986 Tait
4,684,952 A * 8/1987 Munson et al. ..... 343/700 MS
4,749,996 A 6/1988 Tresselt
5,245,745 A 9/1993 Jensen et al.
5,309,164 A 5/1994 Dienes et al.
5,410,323 A 4/1995 Kuroda
5,450,090 A 9/1995 Gels et al.
5,627,550 A * 5/1997 Sanad ..... 343/700 MS
5,764,190 A 6/1998 Murch et al.
5,781,158 A * 7/1998 Ko et al. ..... 343/700 MS
5,835,063 A 11/1998 Brachat et al.
5,936,583 A 8/1999 Sekine et al.
5,943,020 A 8/1999 Liebendoerfer et al.
5,966,096 A 10/1999 Brachat
5,986,606 A 11/1999 Kossiavas et al.
6,002,367 A 12/1999 Engblom et al.
6,008,762 A * 12/1999 Nghiem ..... 343/702
6,046,707 A 4/2000 Gaughan et al.
6,114,996 A * 9/2000 Nghiem ..... 343/702
6,133,880 A * 10/2000 Grangeat et al. .... 343/700 MS
6,140,965 A 10/2000 Van Hoozen
6,140,969 A 10/2000 Lindenmeier et al.
6,147,649 A 11/2000 Ivrissimtzis et al.
6,157,348 A 12/2000 Openlander
6,181,281 B1 1/2001 Desclos et al.

(Continued)

FOREIGN PATENT DOCUMENTS

EP 0 604 338 A 6/1994

(Continued)

OTHER PUBLICATIONS

Wheeler, "Small Antennas," IEEE Transactions on Antennas and Propagation, Jul. 1975.

(Continued)

*Primary Examiner*—Michael C. Wimer
(74) *Attorney, Agent, or Firm*—Foley & Lardner LLP

(57) ABSTRACT

A differential antenna structure configured to connect to an electronic circuit having differential inputs and output. The antenna structure includes differential feeding points which are connected to the electronic circuit differential inputs/outputs through capacitors thus eliminating the need for baluns. The antenna structure is also configured to connect to multiple differential inputs/outputs thus eliminating the need for a separate antenna for each differential input/output included on an electronic circuit chip set. The antenna structure can include feeding arms which act as differential feeding points. The antenna can also include tongues for adjusting the capacitive part of the antenna to allow for 1 to n frequencies. The antenna can comprise multiple antenna elements in various arrangements and configurations.

44 Claims, 21 Drawing Sheets

U.S. PATENT DOCUMENTS

| | | | | |
|---|---|---|---|---|
| 6,195,051 | B1 | 2/2001 | McCoy et al. | |
| 6,211,825 | B1 | 4/2001 | Deng | |
| 6,246,371 | B1 | 6/2001 | Kurz et al. | |
| 6,304,222 | B1 * | 10/2001 | Smith et al. | 343/702 |
| 6,323,810 | B1 * | 11/2001 | Poilasne | 343/700 MS |
| 6,339,409 | B1 | 1/2002 | Warnagiris | |
| 6,348,894 | B1 * | 2/2002 | Lahti | 343/702 |
| 6,369,777 | B1 | 4/2002 | Ohara et al. | |
| 2002/0126052 | A1 * | 9/2002 | Boyle | 343/702 |

FOREIGN PATENT DOCUMENTS

| | | | |
|---|---|---|---|
| EP | 0 942 488 | A | 9/1999 |
| EP | 1 067 627 | A | 1/2001 |
| JP | 56 012102 | | 2/1981 |
| JP | 09 055621 | A | 2/1997 |
| JP | 2000 031735 | A | 1/2000 |
| JP | 2000 068736 | A | 3/2000 |

OTHER PUBLICATIONS

International Search Report from PCT Application No. PCT/US02/20242.

* cited by examiner

- PRIOR ART -

PRIOR ART -

- PRIOR ART -

LOW-PROFILE, MULTI-FREQUENCY, DIFFERENTIAL ANTENNA STRUCTURES

CROSS-REFERENCE TO RELATED APPLICATIONS

This application relates to co-pending application Ser. No. 09/892,928, filed on Jun. 26, 2001, entitled "Multi Frequency Magnetic Dipole Antenna Structure and Methods Reusing the Volume of an Antenna" by L. Desclos et al., owned by the assignee of this application and incorporated herein by reference.

This application relates to co-pending application Ser. No. 10/076,922, entitled "Multi Frequency Magnetic Dipole Antenna Structures with a New E-Field Distribution for Very Low-Profile Antenna Applications" by G. Poilasne et at., owned by the assignee of this application and incorporated herein by reference.

This application relates to co-pending application Ser. No. 10/160,811, entitled "Multi-Band, Low-Profile, Capacitively Loaded Antennas with Integrated Filters" by J. Shamblin et al., owned by the assignee of this application and incorporated herein by reference.

BACKGROUND INFORMATION

1. Field of the Invention

The present invention relates generally to the field of wireless communications, and particularly to the design of antennas with differential inputs and outputs.

2. Background

Certain wireless communications applications, such as those using Bluetooth and other ISM (Industrial Scientific and Medical) bands, use chipsets with differential inputs and outputs. Typically, antennas are only single-ended with a ground reference. When used together, the aforementioned antennas and chipsets are not fully compatible because the chipsets include a balanced line (one that has two conductors with equal currents in opposite directions) and the antennas an unbalanced line (one that has just one conductor and a ground).

To get around this incompatibility, baluns are often included in the design. A balun is a device that joins a balanced line to an unbalanced line. A balun is essentially a type of transformer that is used to convert an unbalanced signal to a balanced one or vice versa. Baluns isolate a transmission line and provide a balanced output.

In the case of multi-band applications, classical solutions are problematic because they require that multiple antennas be dedicated to meet the requirements of the targeted application. Especially in the case of mobile communications devices, where space is at a premium, this can be a serious hurdle to implementation. It can also be costly, because the construction of a balun is expensive, and can cost well more than the antenna itself—and at least several times the cost of capacitors.

The subject of this invention is an antenna with differential inputs and outputs that can be compatible with chipsets used in applications such as Bluetooth and ISM. Advantages of such a solution include efficiency, which is achieved by extraction of more gain from the chipset.

SUMMARY OF THE INVENTION

The present invention allows for multiple antenna elements in myriad physical configurations to cover one to n number of frequencies or bands of frequencies. At the same time, this invention allows for a differential input/output that can be connected to a differential amplifier.

Antenna elements according to the present invention can include both inductive and capacitive parts. Each element can provide a single frequency or band of frequency. The physical design of each element can vary, but generally allows for multiple frequencies by reusing the same design of a single element in multiple.

In one embodiment, a single element has two top plates and a bottom plate. In another embodiment a single element has one unshaped top plate and one bottom plate. In these embodiments, the elements can produce a specific frequency or band of frequency based on their relative size and shape. Different physical configurations can also be considered to adapt the antenna and its elements to the physical environment specific to a particular application. The plates are generally connected to ground and two independent plates can be connected to feeding points.

Once metal pieces have been cut and folded into a desired antenna element form for the purpose of matching a frequency or frequency band, they can then be arranged to target multiple bands. In one embodiment, the elements can be placed one next to the other. In another embodiment, the elements can be stacked, one on top of another. In yet another embodiment, the elements can be inserted one inside the other. Once the multiple elements have been arranged to both meet the frequency and space requirements of the specific application, a multi-frequency, multi-band, capacitively loaded magnetic dipole is produced.

In the proposed solution, a single antenna can cover several frequency bands, as well as a chipset differential configuration. These designs will reduce the overall cost of the system as well as save space and improve efficiency.

This summary does not purport to define the invention. The invention is defined by the claims.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1B:
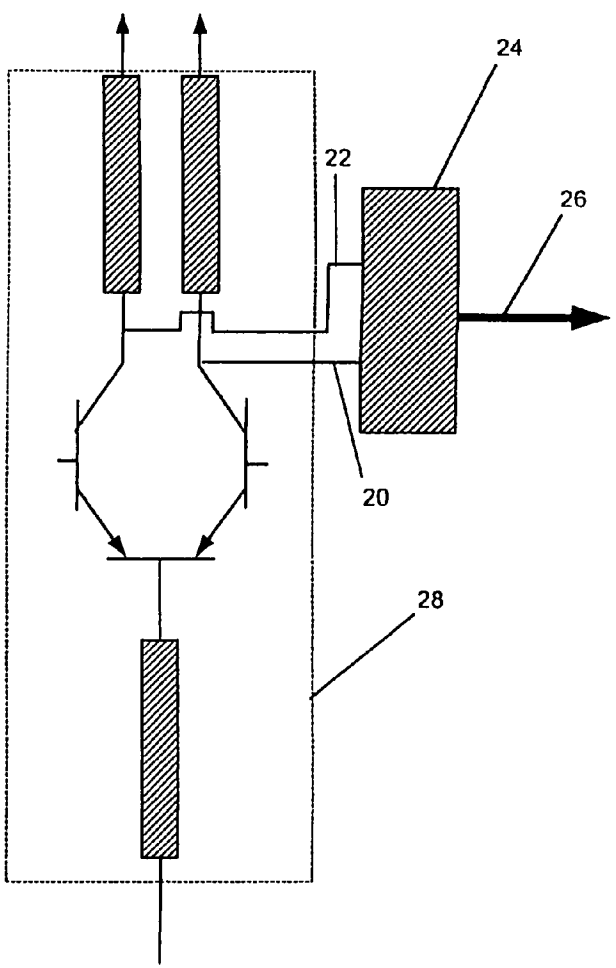
FIG. 1B is a circuit diagram that represents a classical interface between a radio frequency output and an antenna.
Figure 1A:
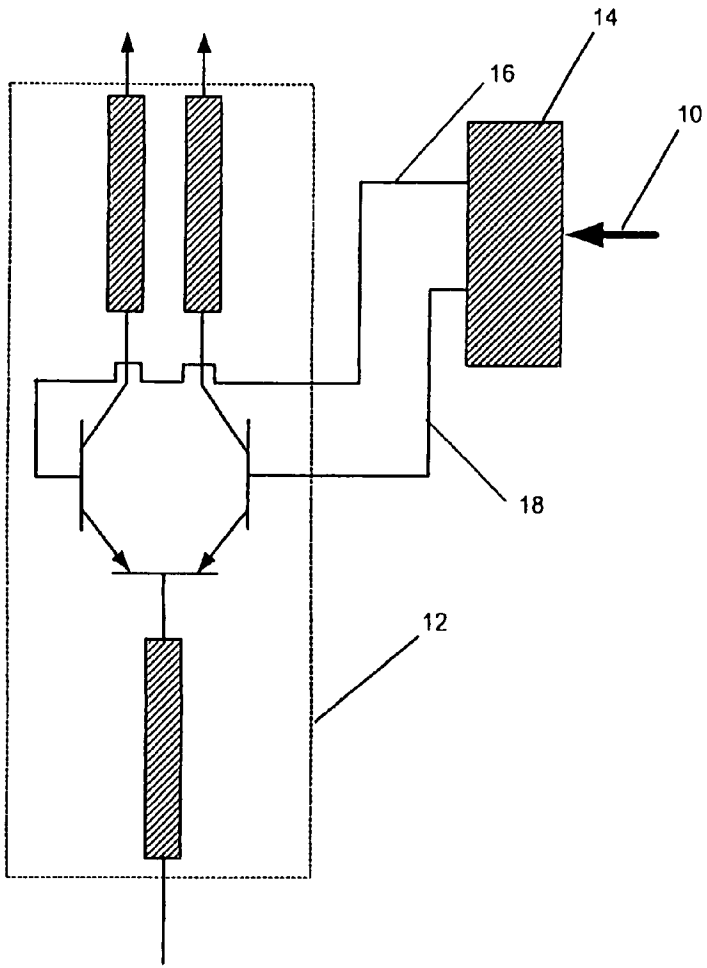
FIG. 1A is a circuit diagram that represents a classical interface between a radio frequency input and an antenna.

FIG. 1A is a circuit diagram that represents a classical interface between a radio frequency input and an antenna. This diagram illustrates a typical differential circuit where the antenna input 10 is connected to a circuit 12 through a balun 14. The balun 14 provides the unbalanced to balanced conversion and breaks the antenna input 10 into differential inputs 16 and 18, which are directly connected to the differential circuit 12. The circuit 12 shown in this figure is a Gilbert Cell cross-coupled differential amplifier circuit, which is one example of a circuit included in a chipset.

Similarly, FIG. 1B is a circuit diagram that represents a classical interface between a radio frequency output and an antenna. This diagram illustrates a typical differential circuit where the differential circuit outputs 20 and 22 are integrated through a balun 24 into an antenna output 26. The circuit 28 shown in this figure is also a Gilbert Cell cross-coupled differential amplifier circuit.

As described above, the baluns 14, 24 are necessary in order to convert the antenna input 10 into differential inputs 16 and 18 and the differential outputs 20 and 22 into an antenna output 26 Thus, through baluns 14 and 24, the differential amplifier circuits 12 and 18 can be connected to signal-ended antennas (not shown in FIG. 1A or 1B).

Figure 2B:
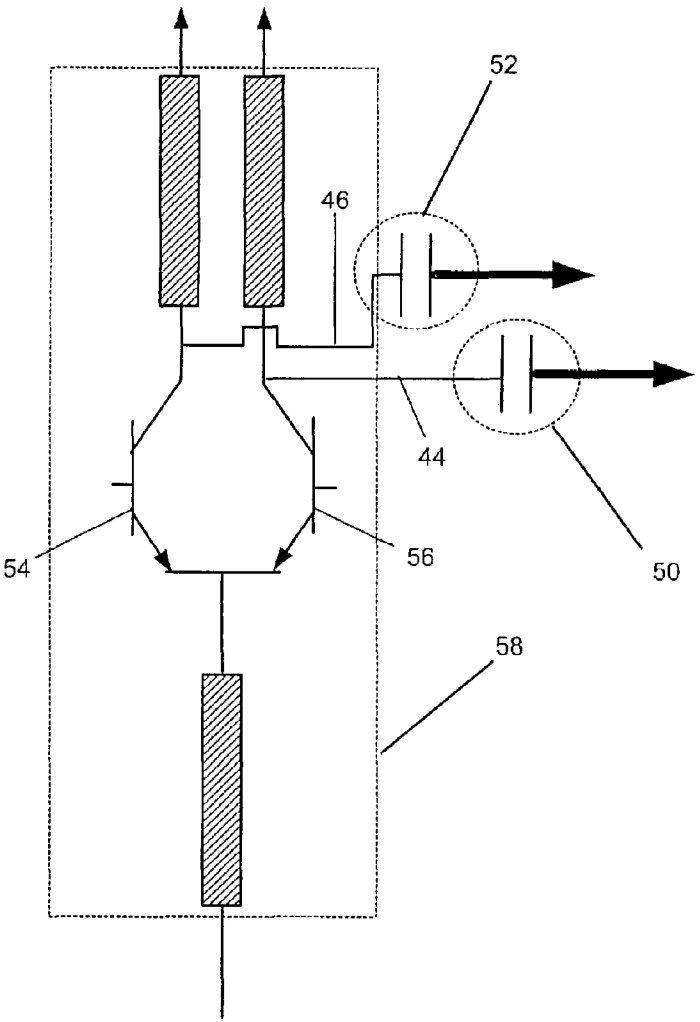
FIG. 2B is a circuit diagram that represents an interface between a radio frequency output and an antenna, in accordance with the present invention.
Figure 2A:
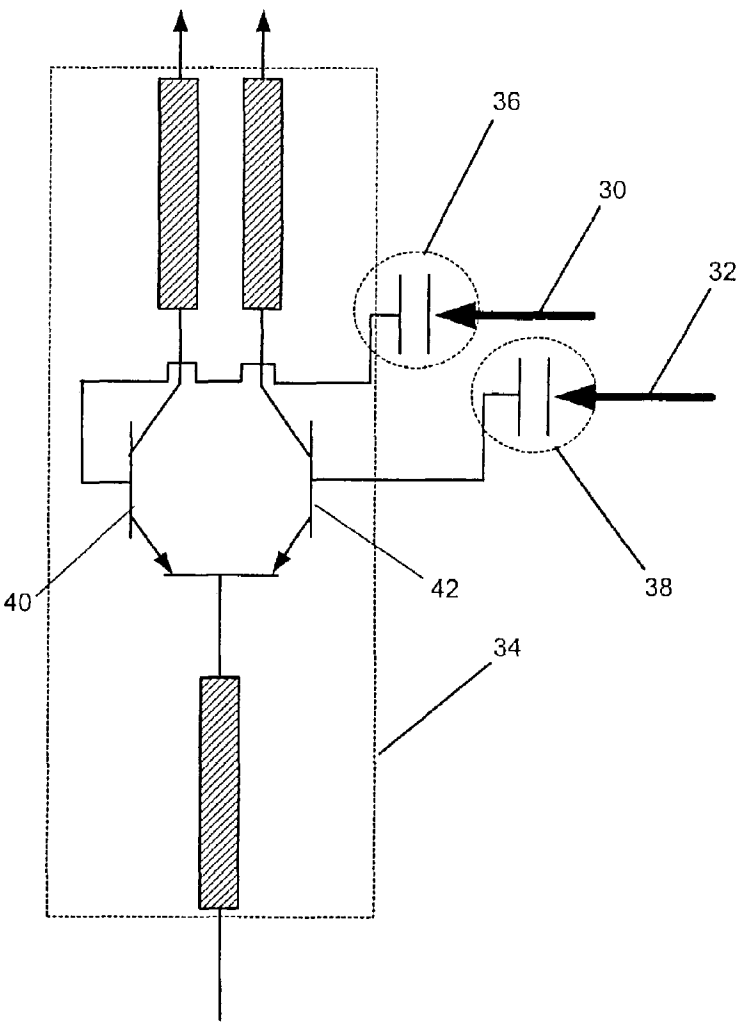
FIG. 2A is a circuit diagram that represents an interface between a radio frequency input and an antenna, in accordance with the present invention.

FIG. 2A is a circuit diagram that represents an interface between a radio frequency input and an antenna, in accordance with the present invention. In this embodiment, inputs 30 and 32 are connected to a differential amplifier circuit 34 through capacitors 36 and 38, respectively. The antenna (not shown in FIG. 2*a*) will have to then present a shift in phase to compensate for the shift of the input of the transistors 40 and 42 of the differential amplifier circuit 34. The antenna, discussed in detail below, is configured with differential outputs for connecting to the inputs 30 and 32 of the differential amplifier circuit 34. The shift in phase can be compensated for by adjusting various dimensions of the antenna, such as plate length and gap or by loading, as disclosed in the related applications referenced above and incorporated herein by reference. The circuit 34 shown in this diagram is also a Gilbert Cell cross-coupled differential amplifier circuit.

FIG. 2B is a circuit diagram that represents an interface between a radio frequency output and an antenna, in accordance with the present invention. In this embodiment differential outputs 44 and 46 are connected to an antenna (not shown in FIG. 2B) through capacitors 48 and 50, respectively. The capacitors 48 and 50 provide isolation between the antenna and chip set and also acts to cut the DC path. Typical capacitor values can be 1 pF for high frequency outputs in the 900 MHz range and 10 pF for low frequency inputs. Obviously, the exact specifications of the capacitors will depend on the particular application. The antenna will have to then present a shift in phase to compensate for the shift of the output of transistors 54 and 56. The circuit 58 shown in this diagram is also a Gilbert Cell cross-coupled differential amplifier circuit.

Figure 3B:
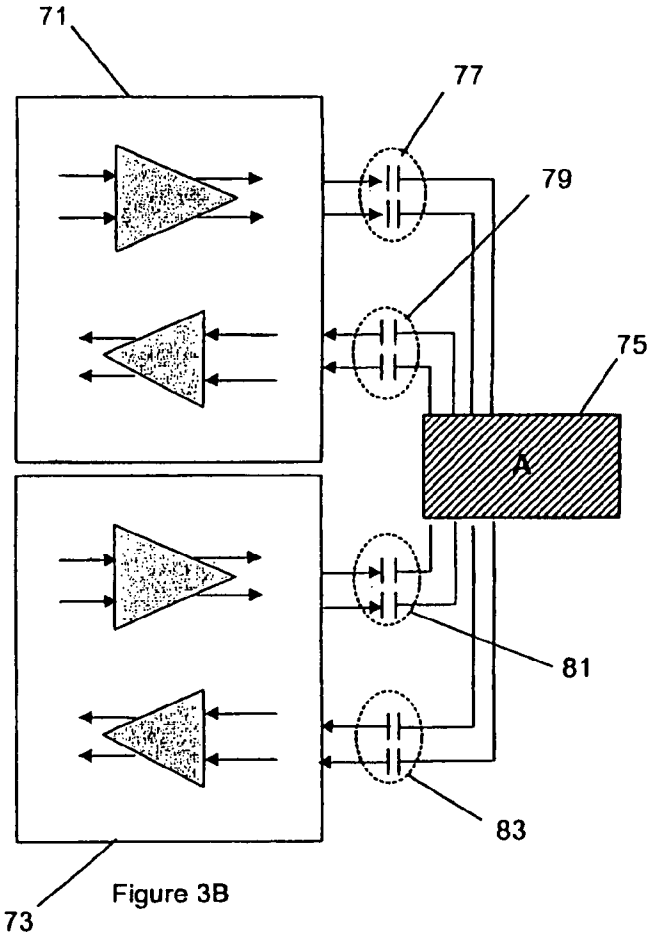
FIG. 3B is a circuit diagram that represents an interface between a radio frequency subsystem and an antenna, in accordance with the present invention.
Figure 3A:
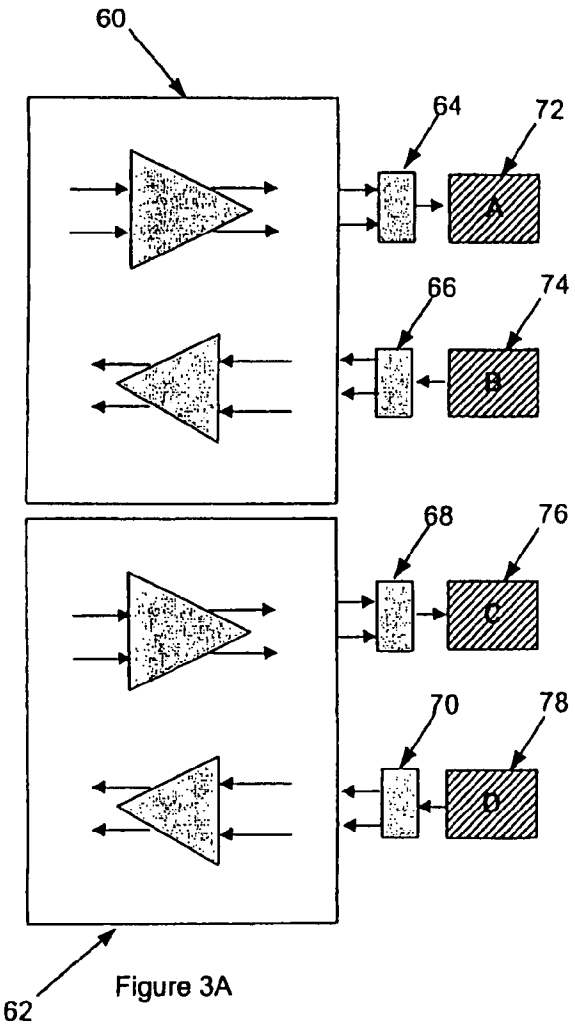
FIG. 3A is a circuit diagram that represents a classical interface between a radio frequency subsystem and an antenna.

FIG. 3A is a circuit diagram of a classical interface between a radio frequency subsystem and an antenna. In this case, there are two frequency bands each produced by a separate radio frequency subsystem 60 and 62. Each subsystem 60 and 62 requires two baluns 64, 66 and 68, 70 and two antennas 72, 74 and 76, 78, respectively. However, there can be n number of frequency bands with 2n number of baluns and antennas.

Figure 4A:
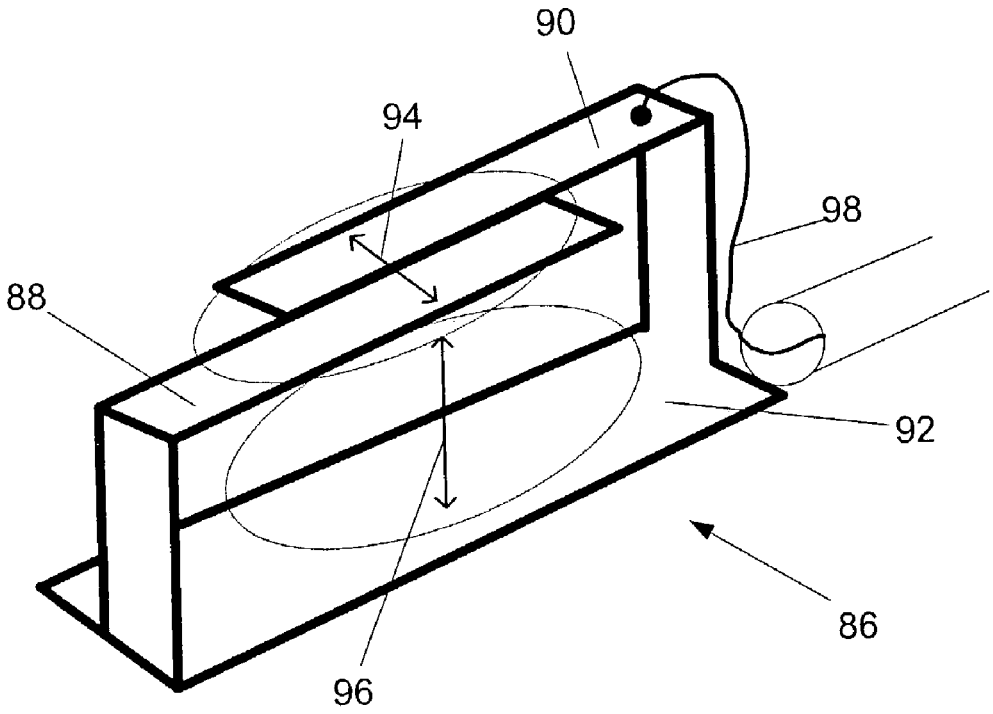
FIG. 4A is a three dimensional view of one embodiment of an antenna element, in accordance with the present invention.
Figure 4B:
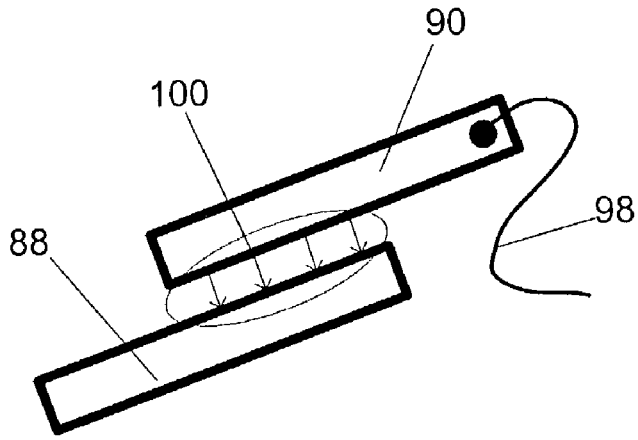
FIG. 4B is a top-view of one embodiment of the antenna element of FIG. 4A.

FIG. 3B is a circuit diagram of an interface between a radio frequency subsystem and an antenna, in accordance with the present invention. In this embodiment, there are again two frequency bands each produced by a separate radio frequency subsystem 71 and 73. Each subsystem 71 and 73 connects to a single antenna 75 through four sets of capacitors 77, 79, 81 and 83. As described in more detail below, in this embodiment, one antenna 75 can serve n number of radio frequency subsystems each producing a separate frequency band FIG. 4A illustrates a three dimensional view of one embodiment of an antenna element, in accordance with the present invention. The antenna element 86 comprises two top plates 88, 90 and a bottom plate 92. The top plates generate the capacitive part 94 of the antenna element 86 while the loop between the top plates 88, 90 and the bottom plate 92 comprises the inductive part 96. Power is supplied to the antenna element 86 through the feeding line 98. FIG. 4B illustrates a top-view of the antenna element 86 of FIG. 4A. As can be seen, a horizontal electric field 100 is produced between the top plates 88 and 90.

Figure 5A:
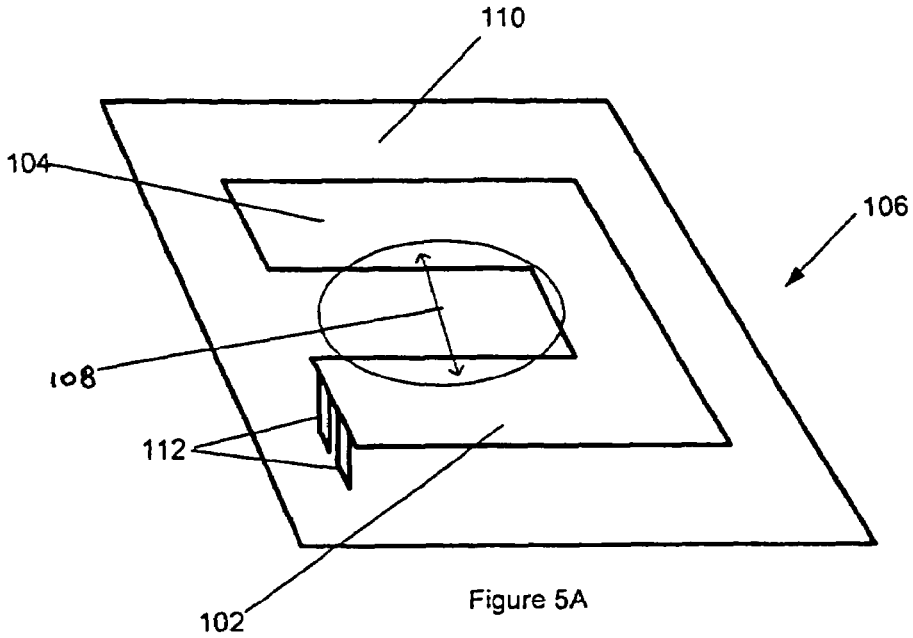
FIG. 5A is a three dimensional view of another embodiment of an antenna element, in accordance with the present invention.

FIG. 5A illustrates a three dimensional view of another embodiment of an antenna element, in accordance with the present invention. In this embodiment, the two top plates 102, 104 of the antenna element 106 are arranged in a U-shape. The top plates 102, 104 produce the capacitive part 108 of the antenna element 106 and are attached to a grounding plane 110, which acts as the bottom plate, by a grounding point 112.

Figure 5B:
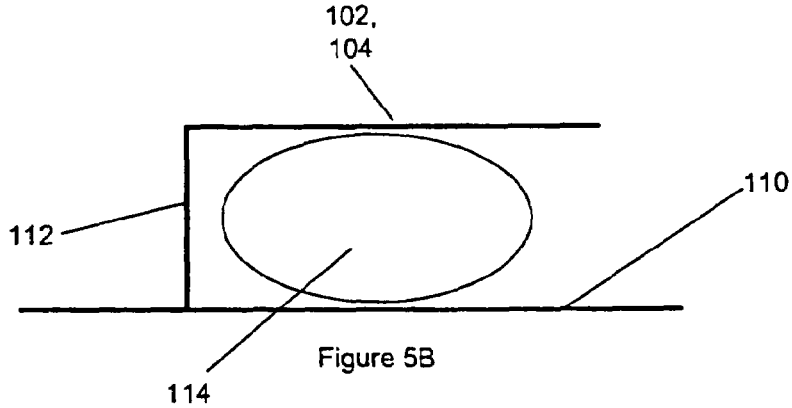
FIG. 5B is a side-view of the antenna element of FIG. 5A.
Figure 5C:
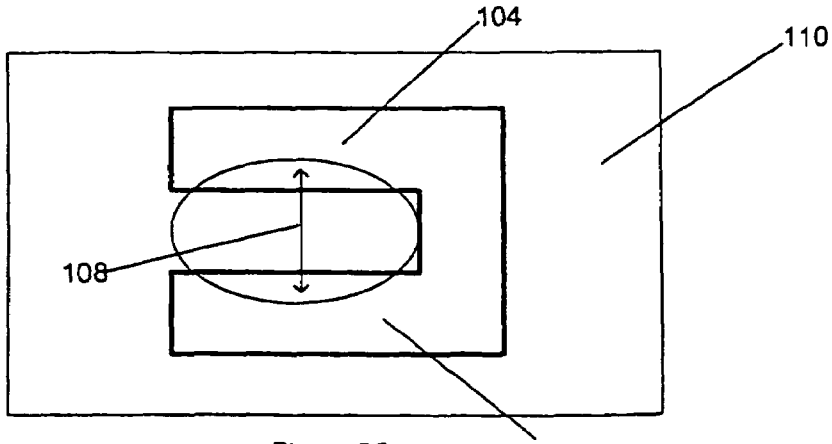
FIG. 5C is a top-view of the antenna element of FIG. 5A.

FIG. 5B illustrates a side-view of the antenna element 106 of FIG. 5A. As can be seen, the loop between the two top plates 102, 104 and the grounding plane 110 forms the inductive part 114 of the antenna element 106. This view also illustrates that the antenna element 106 is attached to the grounding plane 110 by grounding point 112. FIG. 5C illustrates a top-view of the antenna element 106. This view shows that the antenna element 106 sits atop the grounding plane 110.

Figure 6A:
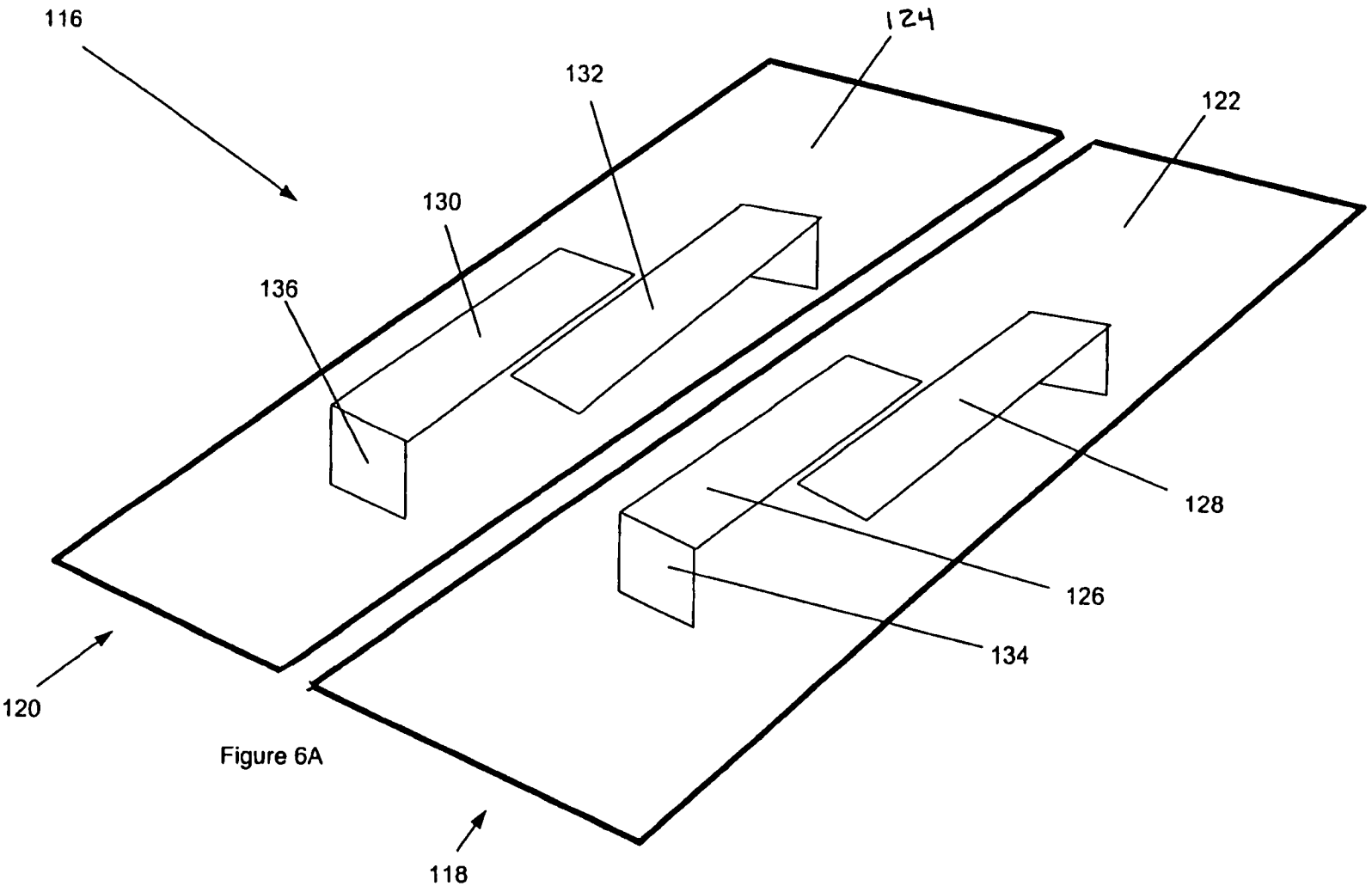
FIG. 6A is a three-dimensional view of one embodiment of an antenna, in accordance with the present invention.

FIG. 6A illustrates a three-dimensional view of one embodiment of an antenna, in accordance with the present invention. The antenna 116 comprises two antenna elements 118, 120, each comprising a ground plane 122, 124 and two top plates 126, 128 and 130, 132, respectively. This configuration provides for a balanced antenna 116 that can address differential input or output. Antennas in this physical configuration can be fed with or without ground separation. There are two feeding points 134 and 136 which can be used to connect the antenna 116 to a set of differential inputs or outputs. In order to operate at a single frequency or frequency band, preferably, the antenna elements 118 and 120 are of substantially the same size and configuration.

Figure 6B:
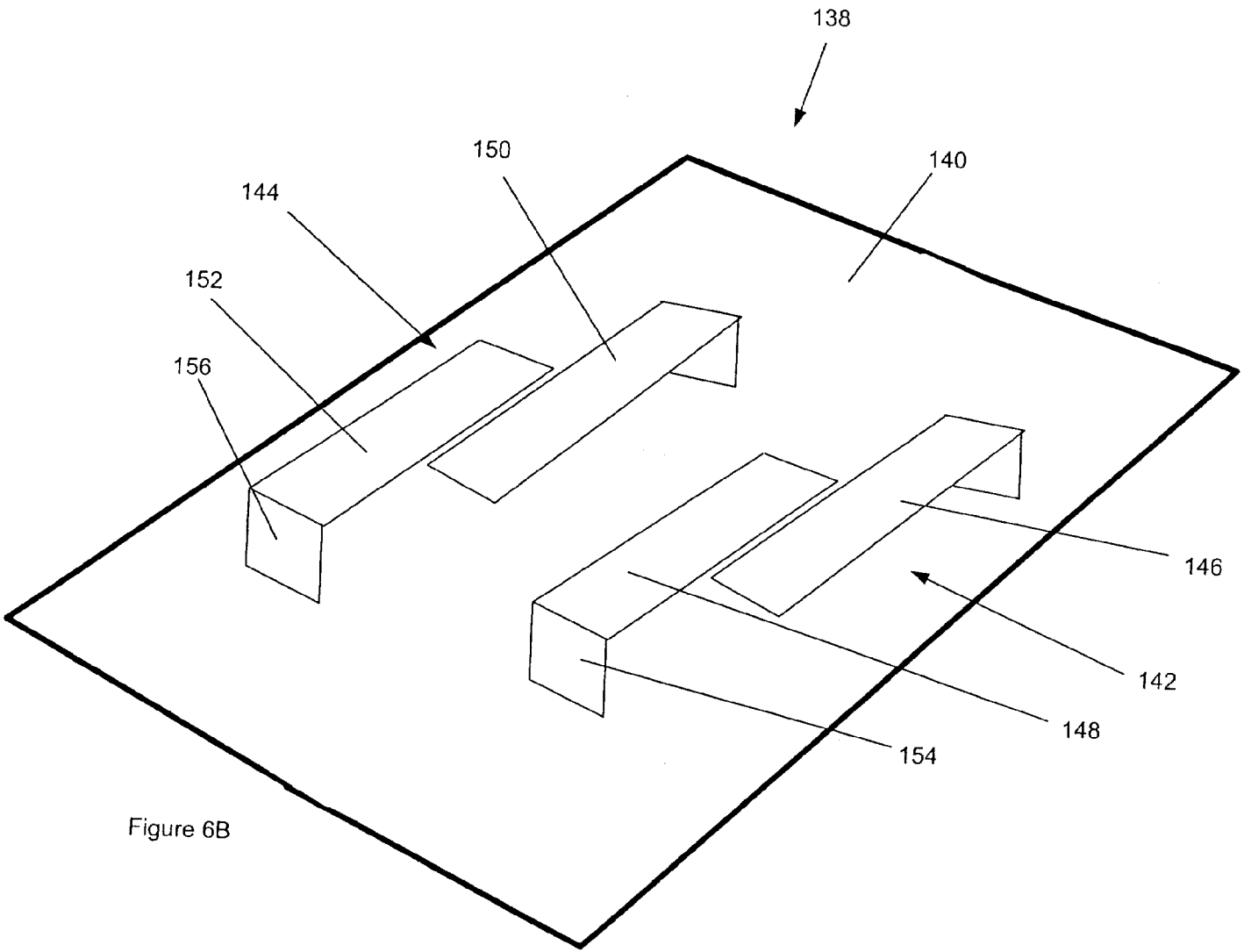
FIG. 6B is a three-dimensional view of another embodiment of an antenna, in accordance with the present invention.

FIG. 6B illustrates a three-dimensional view of another embodiment of an antenna, in accordance with the present invention. In this embodiment, the antenna 138 comprises a single ground plane 140 supporting two separate antenna elements 142, 144 each including two top plates 146, 148 and 150, 152, respectively. There are two feeding points 154, 156 for this antenna 138, one each for an output and an input. This embodiment provides a balanced antenna 138 that can address one differential input or output. Antennas in this physical configuration can be fed with or without ground separation.

Figure 6C:
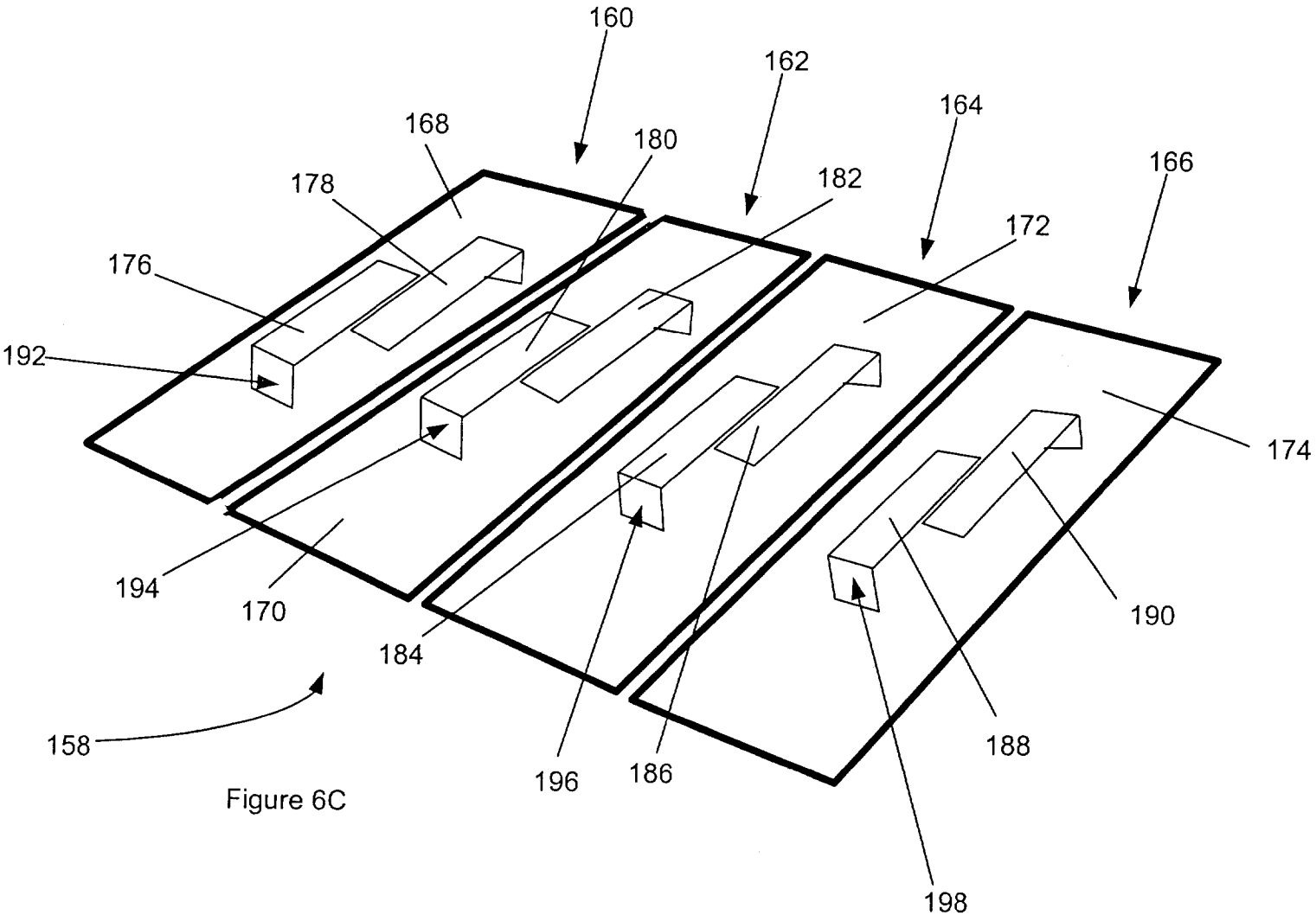
FIG. 6C is a three-dimensional view of another embodiment of an antenna, in accordance with the present invention.

FIG. 6C illustrates a three-dimensional view of another embodiment of an antenna, in accordance with the present invention. In this embodiment, the antenna 158 comprises four separate antenna elements 160, 162, 164, 166 that are fed with separation of the ground planes 168, 170, 172, 174, to provide for a balanced antenna that can address differential inputs or outputs. Again each antenna element 160, 162, 164, 166 comprises two top plates 176, 178, and 180, 182 and 184, 186, and 188, 190, respectively. There are four feeding points 192, 194, 196 and 198, where feeds 192 and 194 are utilized for input and feeds 196 and 198 are utilized for output. Antennas in this physical configuration can be fed with or without ground separation. This model can be modified to meet the requirements of the specific application.

Figure 6D:
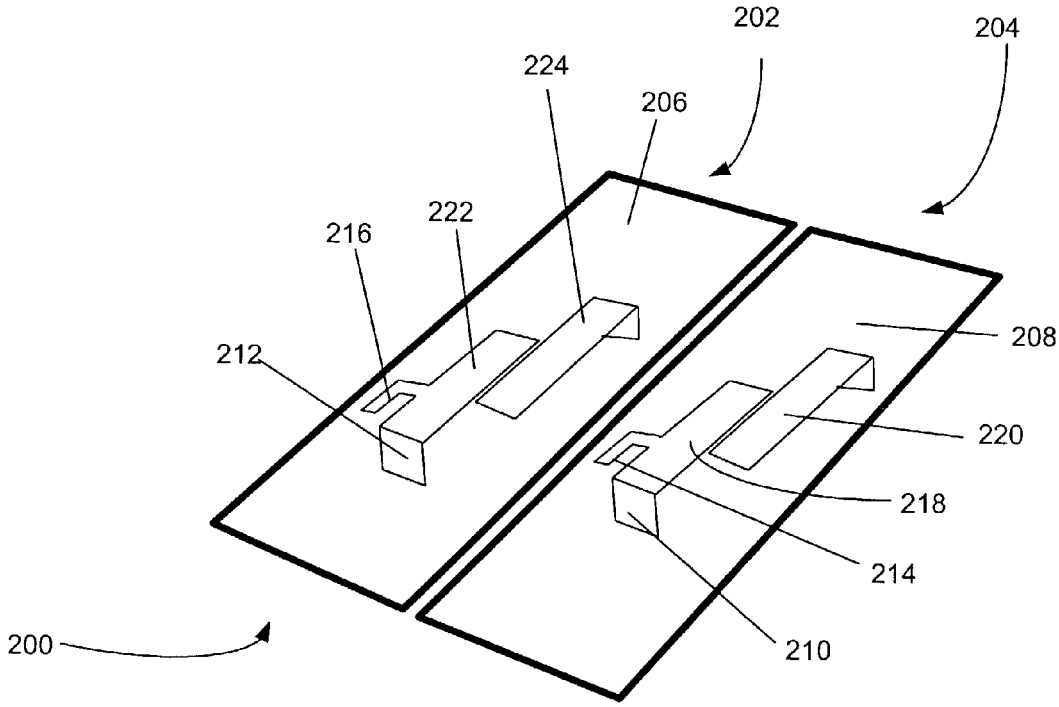
FIG. 6D is a three-dimensional view of another embodiment of an antenna, in accordance with the present invention.

FIG. 6D illustrates a three-dimensional view of another embodiment of an antenna, in accordance with the present invention. In this embodiment, two separate antenna elements 202, 204 are fed with separation of the ground planes 206, 208 to provide for a balanced antenna 200 that can address differential inputs or outputs. Four feeding points 210, 212, 214, 216 can be used for input and output, where 214 and 216 are "arms" that protrude from one 218, 222 of the two top plates 218, 220 and 222, 224 of each antenna element 202, 204. This physical model can be modified and the frequency tuned to meet the requirements of different applications.

Figure 6E:
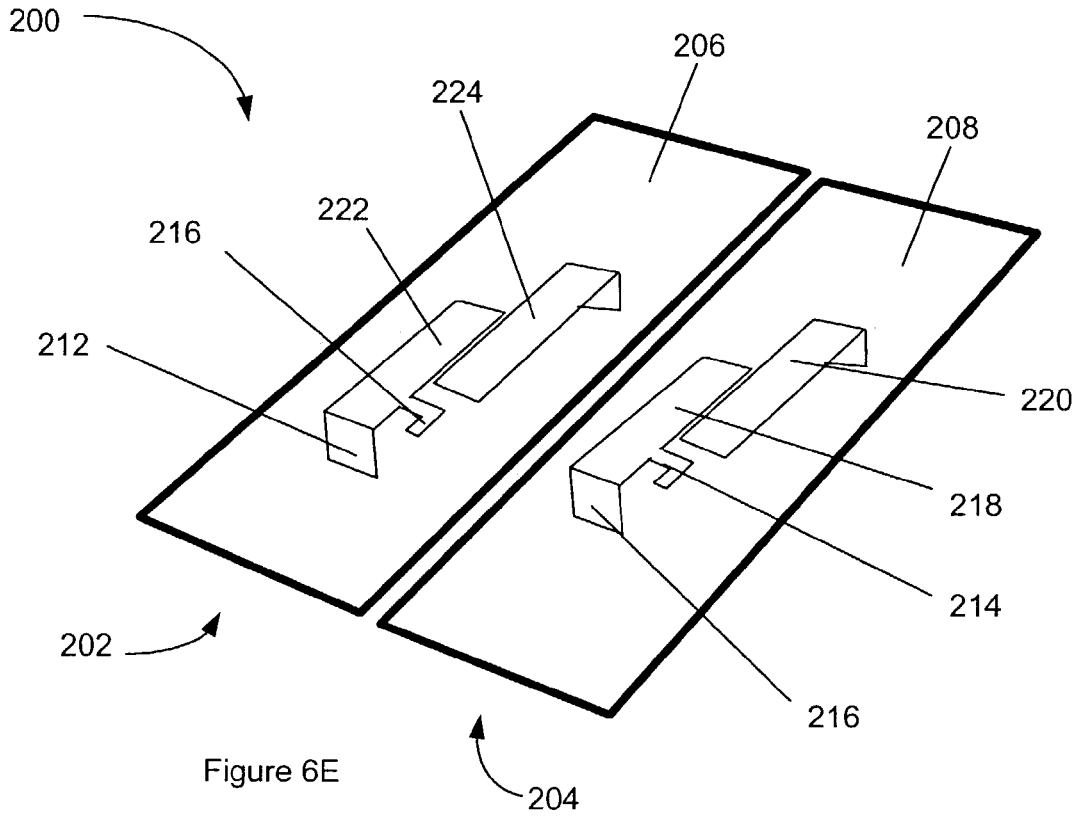
FIG. 6E is a three-dimensional view of another embodiment of an antenna, in accordance with the present invention.
Figure 7:
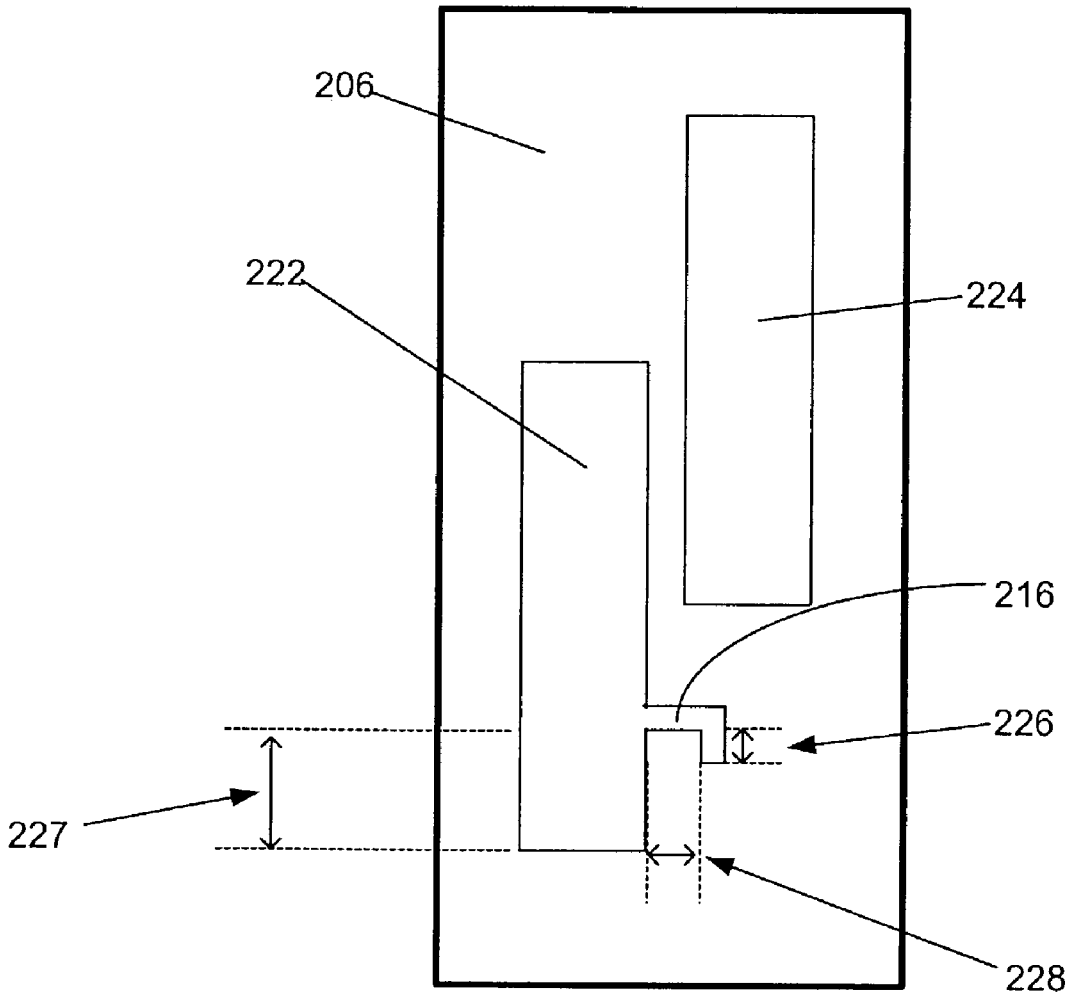
FIG. 7 is a top-view of one of the antenna elements shown in FIG. 6E.

For example, as shown in FIG. 6E, arms 214 and 216 can be configured to protrude inward, as opposed to the outward protrusion shown in FIG. 6D. FIG. 7 illustrates a top-view of one antenna element 202 of the antenna 200 of FIG. 6E. Through modification of the physical characteristics of the feed-point "arm" 216, for example, dimensions 226, 227, and 228, one can tune the frequency of the antenna 200 to meet the requirements of different applications. However, in this embodiment, the transmitter (not shown) should be turned off when the receiver (not shown) is working and vice versa.

Figure 8:
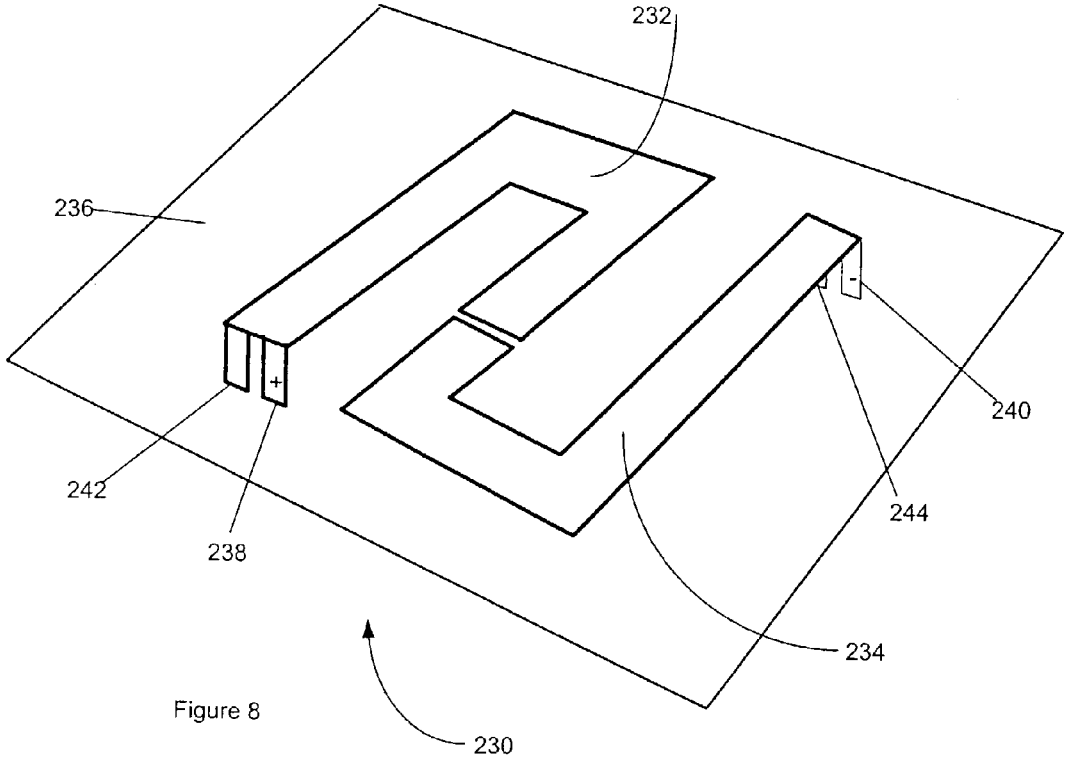
FIG. 8 is a three-dimensional view of another embodiment of an antenna, in accordance with the present invention.

FIG. 8 illustrates a three-dimensional view of another embodiment of an antenna, in accordance with the present invention. In this embodiment, the antenna 230 comprises two separate antenna elements 232, 234 that are fed atop a single ground plane 236. The antenna 230 includes two feeding points 238, 240, one for input 238 and one for output 240, and two grounding points 242, 244.

Figure 9:
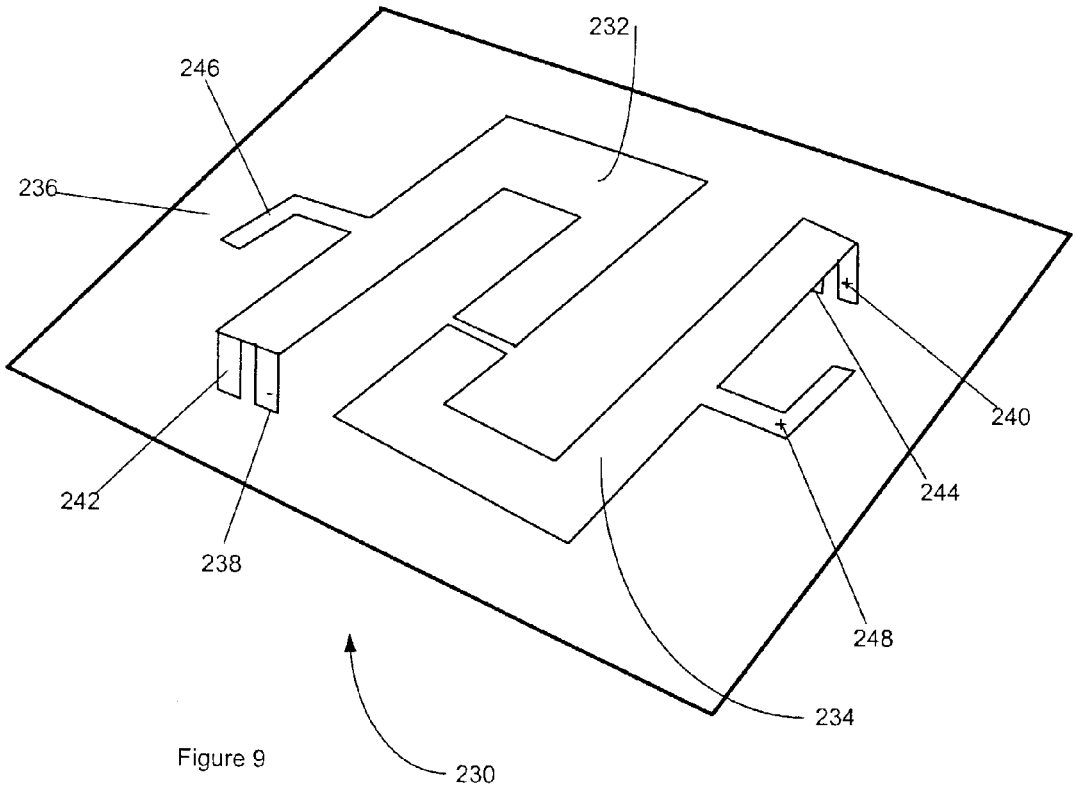
FIG. 9 is a three-dimensional view of another embodiment of an antenna, in accordance with the present invention.

FIG. 9 illustrates a three-dimensional view of another embodiment of an antenna, in accordance with the present invention. This embodiment is similar to the one shown in FIG. 8, but includes two additional "arm" feeding points 246 and 248. Thus, this embodiment includes four feeding points: the two feed-point "arms" 246 and 248, which can be used for output, and feed points 238, 240 which can be used for input.

Figure 10:
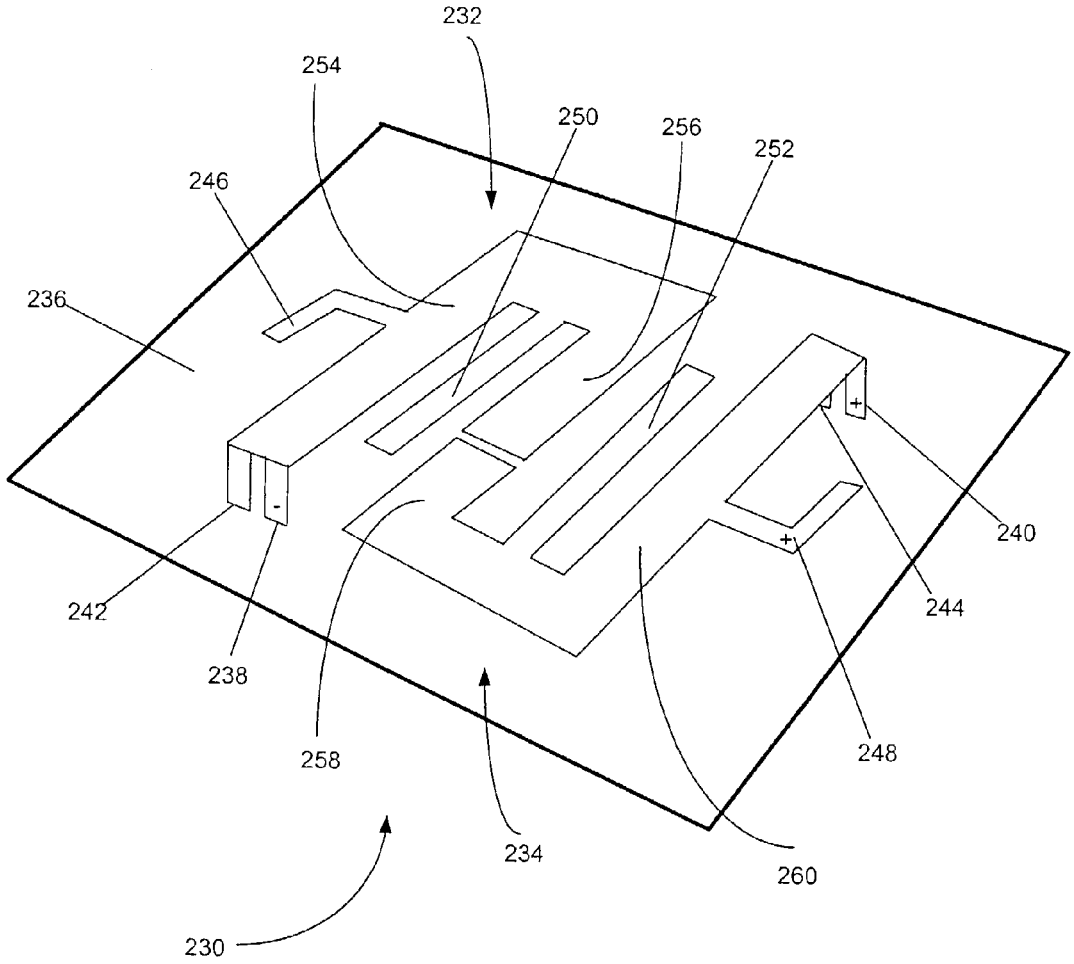
FIG. 10 is a three-dimensional view of an another embodiment of an antenna, in accordance with the present invention.
Figure 11:
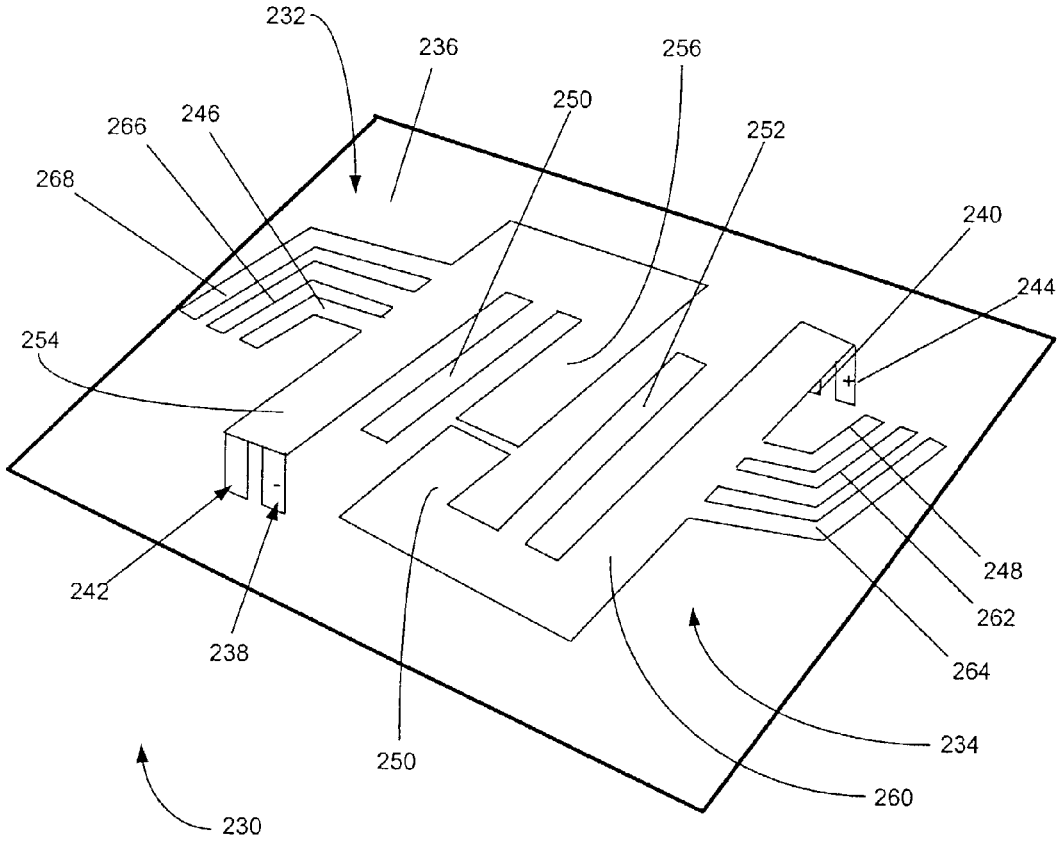
FIG. 11 is a three-dimensional view of an another embodiment of an antenna, in accordance with the present invention.

FIG. 10 illustrates a three-dimensional view of another embodiment of an antenna, in accordance with the present invention. This embodiment is similar to one shown in FIG. 9, with the addition of tongues 250, 252 between the top plates 254, 256, and 258, 260, of each antenna element 232, 234, respectively. The tongues 250, 252 enable adjustments in the capacitance of the antenna 230 to allow for one to n frequencies. In this scenario, there will be a set of dual-frequency outputs or inputs that will generate the differential behavior. FIG. 11 illustrates a three-dimensional view of another embodiment of an antenna, in accordance with the present invention. This embodiment expands upon the one shown in FIG. 10. In this embodiment additional feeding arms 262, 264, 266, and 268 are added. The additional feeding arms expand the number of inputs and outputs available for multifrequency elements.

Figure 12:
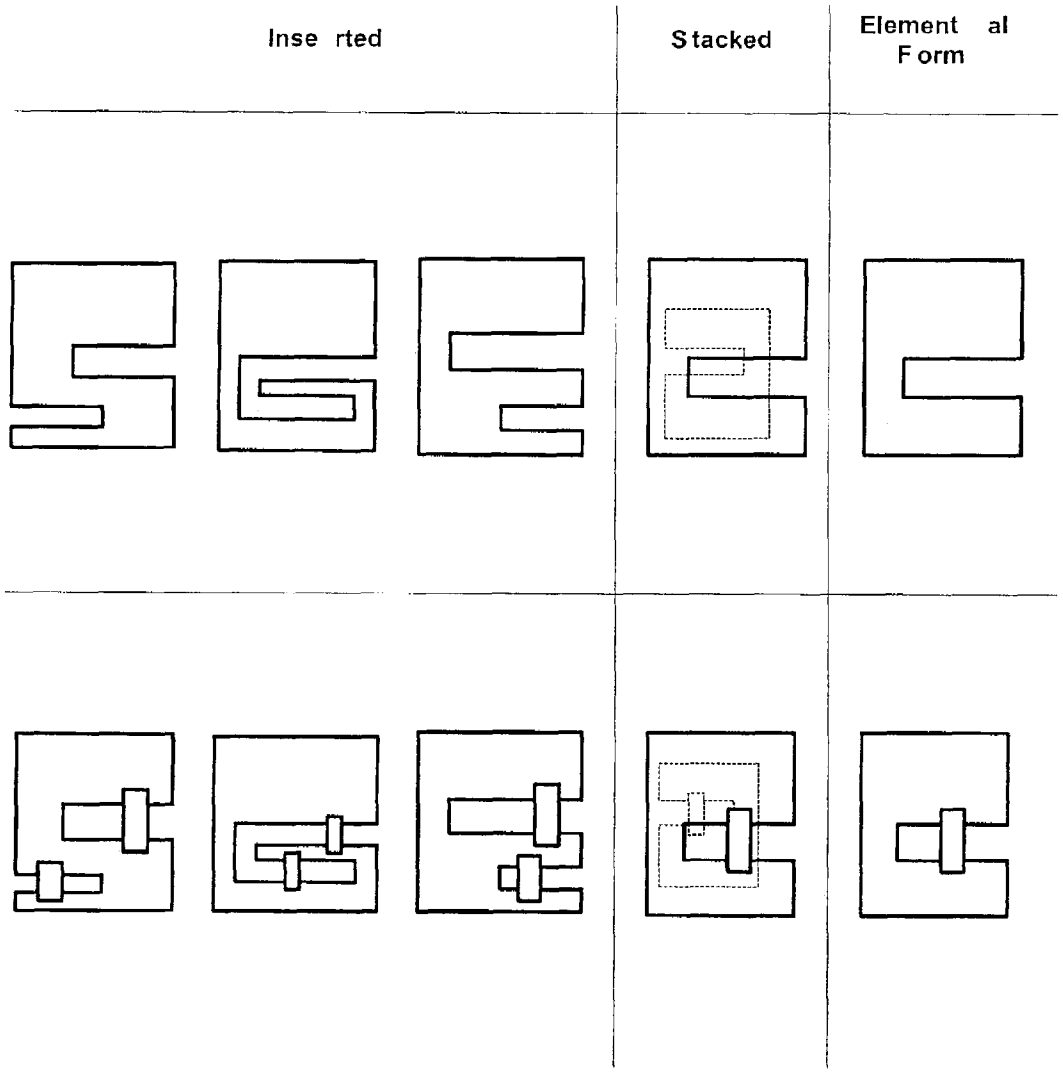
FIG. 12 is a top view of various possible antenna elements for use in accordance with the present invention.

FIG. 12 illustrates a matrix of potential combinations and arrangements of antennas elements, in accordance with the present invention. By combining or arranging the antenna elements from any row or column in the matrix, one enables one to n frequencies as multi-mode differential antennas.

Figure 13:
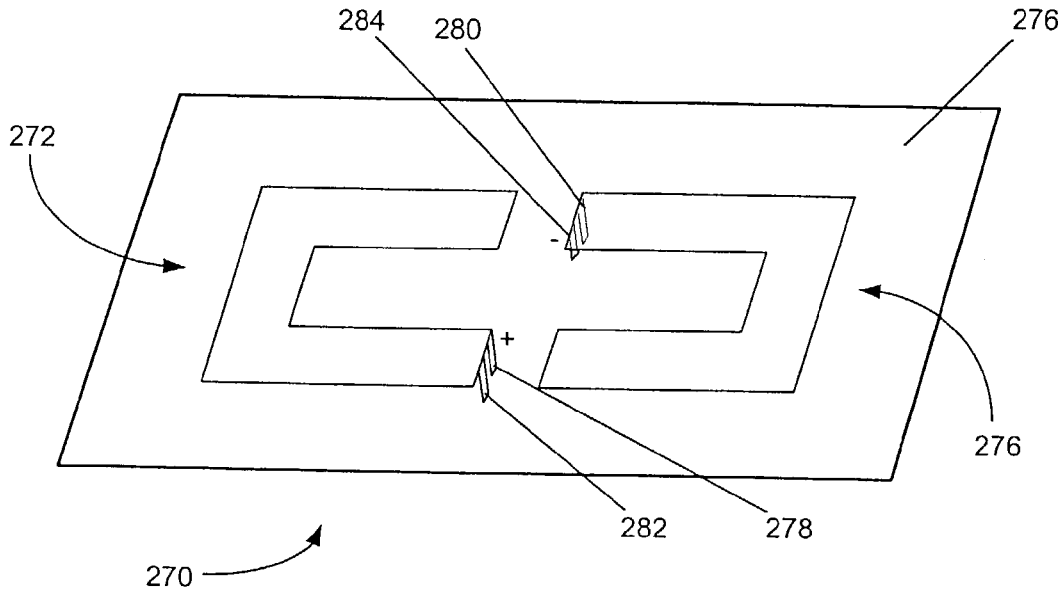
FIG. 13 is a three dimensional view of another embodiment of an antenna, in accordance with the present invention.
Figure 14A:
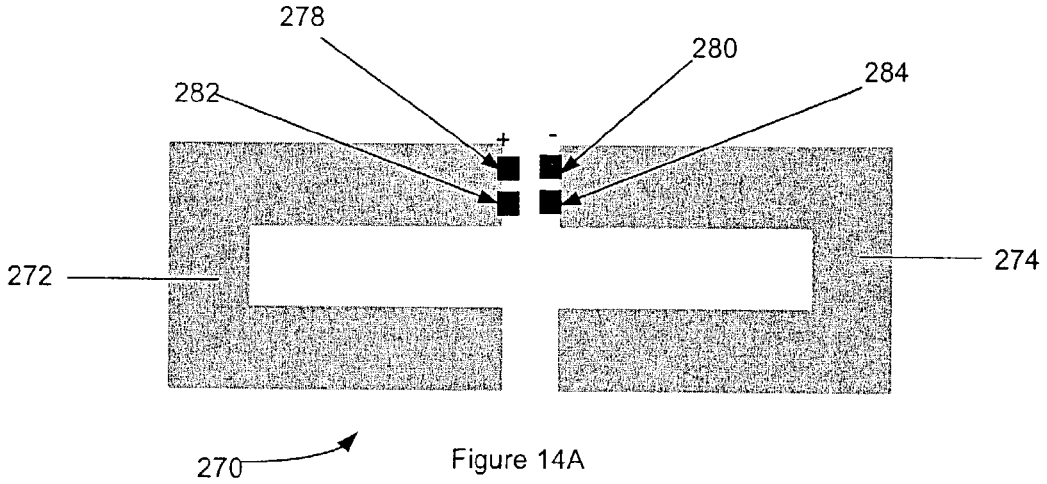
FIG. 14A is a top-view of an alternative embodiment of the antenna of FIG. 13, in accordance with the present invention.
Figure 14B:
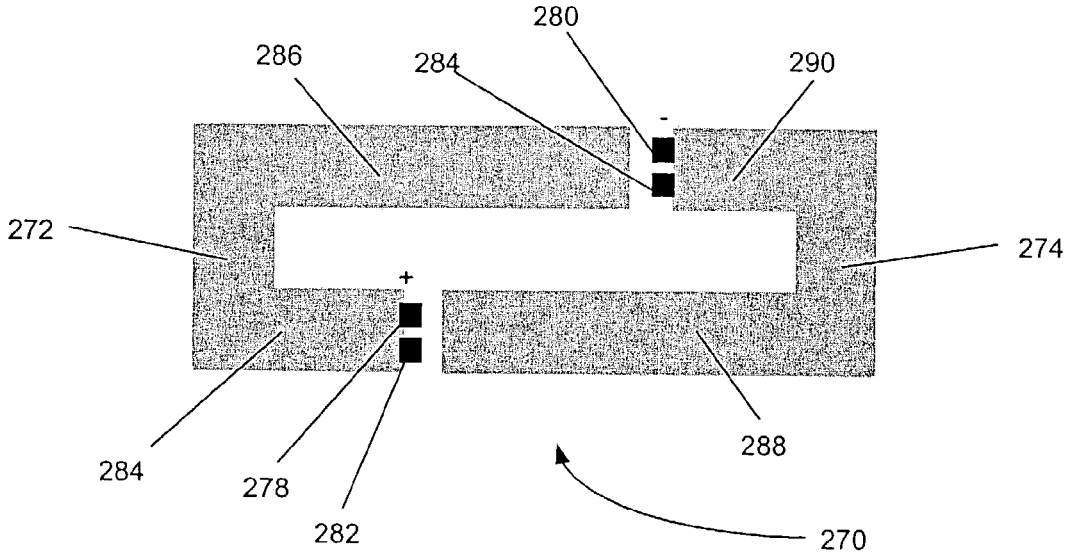
FIG. 14B is a top-view of an alternative embodiment of the antenna of FIG. 13, in accordance with the present invention.

FIG. 13 illustrates a three dimensional view of another embodiment of an antenna, in accordance with the present invention. In this embodiment, the antenna 270 comprises two separate antenna elements 272 and 274 atop a ground plane 276. There are two feeding points 278, 280 that can be used for input and output and there are also two grounding points 282, 284. FIG. 14A illustrates a top-view of an alternative embodiment of the antenna of FIG. 13. In this embodiment, the feed points 278, 280 and grounding points 282, 284 are positioned opposite each other on the two antenna elements 272, 274. Similarly, FIG. 14B is an alternative embodiment of the antenna 270 of FIG. 13. In this embodiment, the feeding points 278, 280 and grounding points 282, 284 are in the same position as in FIG. 13, but the lengths of the top plates 284, 286 and 288, 290 of antenna elements 272 and 274 are different.

Figure 15A:
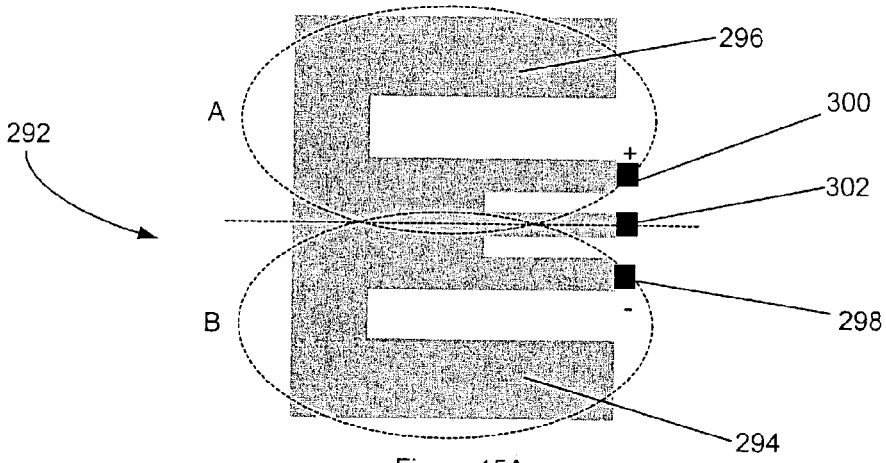
FIG. 15A is a top view of another embodiment of an antenna, in accordance with the present invention.
Figure 15B:
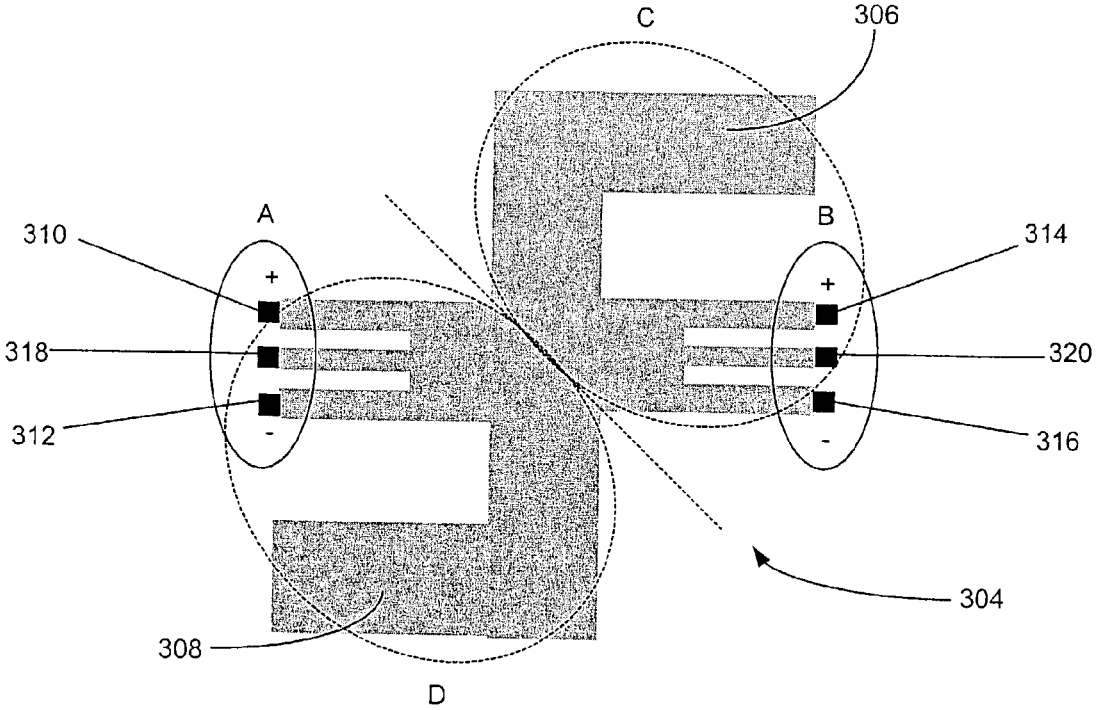
FIG. 15B is a top view of another embodiment of an antenna, in accordance with the present invention.

FIG. 15A illustrates a top view of another embodiment of an antenna, in accordance with the present invention. The antenna 292 of this embodiment comprises two antenna elements 294, 296. Each element has a feeding point 298, 300 and the two elements 294, 296 share a grounding point 302. FIG. 15B illustrates another of the various possible embodiments of an antenna, in accordance with the present invention. The antenna 304 comprises two connected antenna elements 306 and 308. This embodiment includes four feeding points 310, 312, 314, and 316, and two grounding points 318, 320. In this example, the feeding points 310, 312 can be inputs and feeding points 314, 316 can be outputs.

Figure 15C:
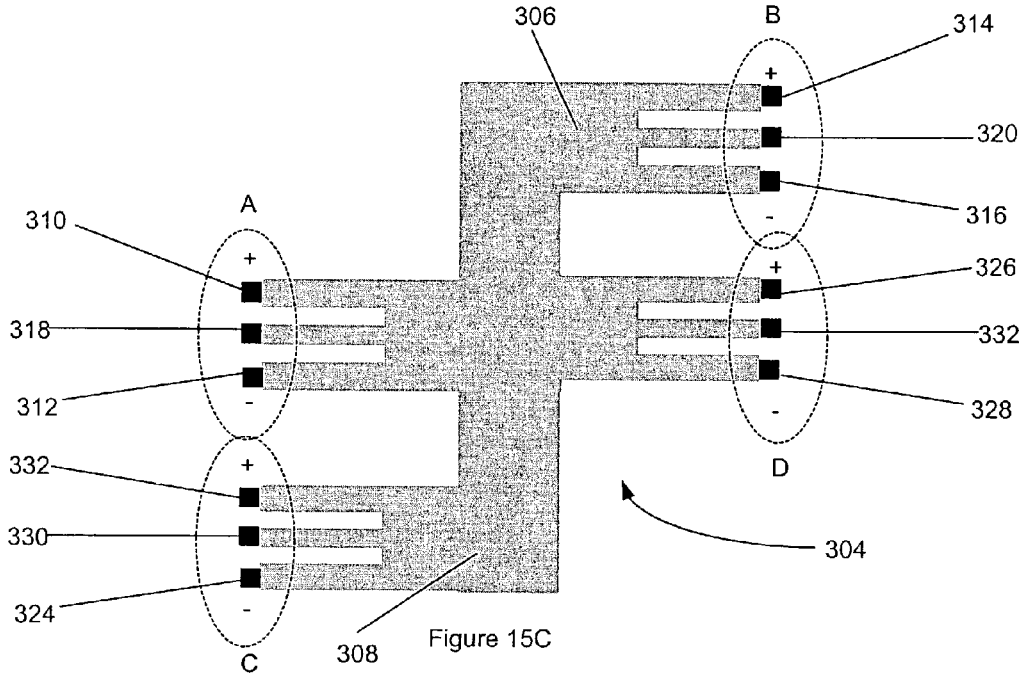
FIG. 15C is a top view an alternative embodiment of the antenna of FIG. 15B, in accordance with the present invention.
Figure 15D:
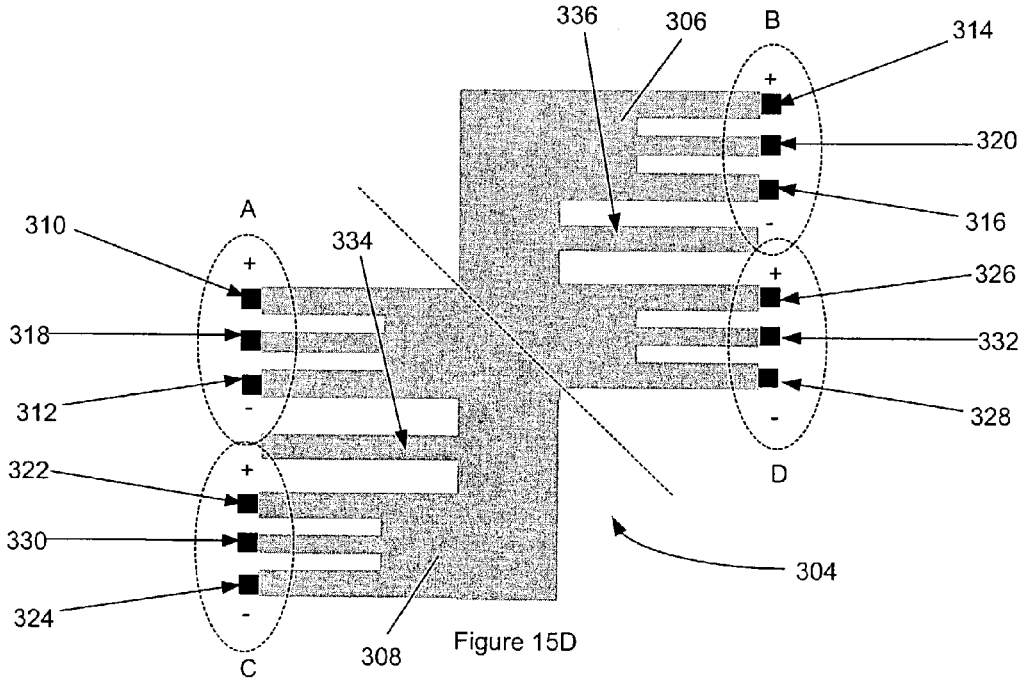
FIG. 15D is a top view of an alternative embodiment of the antenna of FIG. 15C, in accordance with the present invention

FIG. 15C illustrates an alternative embodiment of the antenna 304 shown in FIG. 15B. This embodiment includes eight feeding points 310, 312, 314, 316, 322, 324, 326, 328 and four grounding points 318, 320, 330, and 332. In this example, the feeding points 310 and 312 represent the output group for a first frequency, while feeding points 314 and 316 represent the input group for that same frequency, while feeding points 326 and 328 can represent the input group for that same frequency. FIG. 15D illustrates an alternative embodiment of the antenna 304 shown in FIG. 15C with the addition of tongues 334 and 336. The tongues 334 and 336 enable one to n frequencies.

Figure 16:
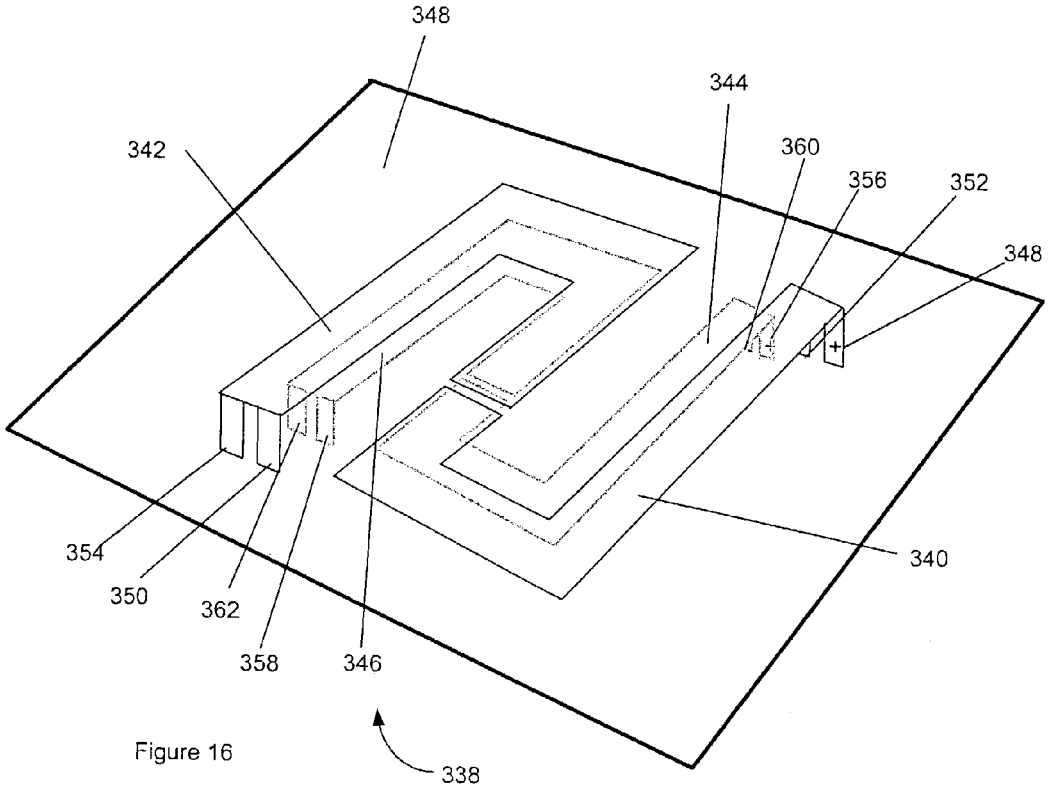
FIG. 16 is a three dimensional view of another embodiment of an antenna, in accordance with the present invention.

FIG. 16 illustrates a three dimensional view of another embodiment of an antenna, in accordance with the present invention. In this embodiment, the antenna 338 comprises four antenna elements 340, 342, 344, and 346 that sit atop a single ground plane 348. The two larger elements 340 and 342 each include a feeding point 348 and 350, respectively that can be used for input and output. Each element also includes a grounding point 352, 354. The two smaller elements 344 and 346 are stacked inside the two larger elements 340 and 342. Each of the smaller elements 344 and 346 also includes a feeding point 356, 358, which can be used for input and output, and a grounding point 360, 362, respectively.

While embodiments and implementations of the invention have been shown and described, it should be apparent that many more embodiments and implementations are within the scope of the invention. Accordingly, the invention is not to be restricted, except in light of the claims and their equivalents.

We claim:

1. An antenna configured for connecting to an electronic circuit having a first differential input and first differential output, the antenna comprising:

a first differential feeding point;

a first capacitor connected between the first differential feeding point and the first differential input, wherein the first capacitor eliminates the need for placing a balun between the first differential feeding point and the first differential input;

a second differential feeding point; and a second capacitor connected between the second differential feeding point and the first differential output;

wherein the second capacitor eliminates the need for placing a balun between the second differential feeding point and the first differential output.

2. The antenna of claim 1 wherein the electronic circuit includes a plurality of differential inputs and wherein the antenna further comprises a plurality of feeding points and a plurality of capacitors, each feeding point being connected to one of the plurality of differential inputs through one of the plurality of capacitors.

3. The antenna of claim 2 wherein the electronic circuit further includes a plurality of differential outputs and wherein each of the plurality of feeding points is connected to one of either the plurality of differential inputs or outputs through one of the plurality of capacitors.

4. The antenna of claim 1 wherein the second differential input further comprises a feeding arm.

5. The antenna of claim 1 wherein the antenna is configured to compensate for a phase shift in the first differential input is created by the electronic circuit.

6. The antenna of claim 1 wherein the antenna is configured to compensate for a phase shift in the first differential output created by the electronic circuit.

7. The antenna of claim 4 wherein the dimensions of the feeding arm can be modified to tune the frequency of the antenna.

8. An antenna configured for connecting to an electronic circuit having a first differential input, the antenna comprising:

a first differential feeding point;

a first capacitor connected between the first differential feeding point and the first differential input, wherein the first capacitor eliminates the need for placing a balun between the first differential feeding point and the first differential input; and an antenna element having three plates which form a capacitive part and an inductive part of the antenna.

9. The antenna of claim 8 wherein said three plates comprise two top plates and a bottom plate and wherein said two top plates produce the capacitive part of the antenna and a loop created between the two top plates and the bottom plate produces the inductive part of the antenna.

10. The antenna of claim 9 wherein the two top plates are positioned adjacent to each other.

11. The antenna of claim 9 wherein the two top plates form a U-shaped top structure.

12. The antenna of claim 11 further comprising a tongue positioned between the two top plates, the tongue being configured to enable adjustments to the capacitive part of the antenna to allow for one to n frequencies.

13. The antenna of claim 8 wherein the antenna comprises a plurality of antenna elements.

14. An antenna configured for connecting to an electronic circuit, the antenna comprising:

a first differential feeding point;

a first capacitor connected between the first differential feeding point and a first differential output, wherein the first capacitor eliminates the need for placing a balun between the first differential feeding point and the first differential output;

a second differential output; and a second capacitor and a feeding arm which acts as a second differential feeding point, the feeding arm being connected to the second differential output through the second capacitor.

15. The antenna of claim 14 wherein the electronic circuit includes a plurality of differential outputs and wherein the antenna further comprises a plurality of feeding points and a plurality of capacitors, each feeding point being connected to one of the plurality of differential outputs through one of the plurality of capacitors.

16. The antenna of claim 14 wherein the antenna further comprises an antenna element having three plates which form a capacitive part and an inductive part of the antenna.

17. The antenna of claim 16 wherein said three plates comprise two top plates and a bottom plate and wherein said two top plates produce the capacitive part of the antenna and a loop created between the two top plates and the bottom plate produces the inductive part of the antenna.

18. The antenna of claim 17 wherein the two top plates are positioned adjacent to each other.

19. The antenna of claim 17 wherein the two top plates form a U-shaped top structure.

20. The antenna of claim 19 further comprising a tongue positioned between the two top plates, the tongue being configured to enable adjustments to the capacitive part of the antenna to allow for one to n frequencies.

21. The antenna of claim 14 wherein the antenna is configured to compensate for a phase shift in the first differential output created by the electronic circuit.

22. The antenna of claim 16 wherein the antenna comprises a plurality of antenna elements.

23. The antenna of claim 14 wherein the dimensions of the feeding arm can be modified to tune the frequency of the antenna.

24. An antenna configured for connecting to an electronic circuit, the antenna comprising:

at least two antenna elements, each antenna element having at least one differential feeding point wherein one of the at least one differential feeding points is configured to be connected to a differential input of the electronic circuit;

a differential output and wherein one of the at least one differential feeding points is configured to be connected to a differential output of the electronic circuit; and a first capacitor connected between the at least one differential feeding point and the differential output, wherein the first capacitor eliminates the need for placing a balun between the at least one first differential feeding point and the differential output.

25. The antenna of claim 24 further comprising a second capacitor connected between the least one differential feeding point and the differential input, wherein the second capacitor eliminates the need for placing a balun between the at least one first differential feeding point and the differential input.

26. The antenna of claim 24 wherein each of the at least two antenna elements comprises three plates which form a capacitive part and an inductive part of the antenna.

27. The antenna of claim 26 wherein the three plates comprise two top plates and a bottom plate and wherein the two top plates produce the capacitive part of the antenna and a loop created between the two top plates and the bottom plate produces the inductive part of the antenna.

28. The antenna of claim 27 wherein the two top plates are positioned adjacent to each other.

29. The antenna of claim 27 wherein the two top plates form a U-shaped top structure.

30. The antenna of claim 29 further comprising a tongue positioned between the two top plates, the tongue being configured to enable adjustments to the capacitive part of the antenna to allow for one of n frequencies.

31. The antenna of claim 24 wherein the antenna is configured to compensate for a phase shift in the differential input created by the electronic circuit.

32. The antenna of claim 24 wherein the antenna is configured to compensate for a phase shift in the differential output created by the electronic circuit.

33. An antenna configured for connecting to an electronic circuit, the antenna comprising:

at least two antenna elements, each antenna element having at least one differential feeding point wherein one of the at least one differential feeding points is configured to be connected to a first differential input;

a feeding arm which acts as a second differential feeding point, the feeding arm being configured to be connected to a second differential input; and a second capacitor connected between the feeding arm and the second differential input, wherein the second capacitor eliminates the need for placing a balun between the feeding arm and the second differential input.

34. The antenna of claim 33 wherein the dimension of the feeding arm can be modified to tune the frequency of the antenna.

35. An antenna configured for connecting to an electronic circuit having a differential output, the antenna comprising:

at least two antenna elements, each antenna element having at least one differential feeding point wherein one of the at least one differential feeding points is configured to be connected to the electronic circuit differential output;

wherein each of the at least two antenna elements comprises three plates which form a capacitive part and an inductive part of the antenna.

36. The antenna of claim 35 further comprising a first capacitor connected between the least one differential feeding point and the differential output, wherein the first capacitor eliminates the need for placing a balun between the at least one differential feeding point and the differential output.

37. The antenna of claim 35 wherein the three plates comprise two top plates and a bottom plate and wherein the two top plates produce the capacitive part of the antenna and a loop created between the two top plates and the bottom plate produces the inductive part of the antenna.

38. The antenna of claim 37 wherein the two top plates are positioned adjacent to each other.

39. The antenna of claim 37 wherein the two top plates form a U-shaped top structure.

40. The antenna of claim 39 further comprising a tongue positioned between the two top plates, the tongue being configured to enable adjustments to the capacitive part of the antenna to allow for one of n frequencies.

41. The antenna of claim 35 wherein the antenna is configured to compensate for a phase shift in the differential output created by the electronic circuit.

42. An antenna configured for connecting to an electronic circuit, the antenna comprising:

at least two antenna elements, each antenna element having at least one differential feeding point wherein one of the at least one differential feeding points is configured to be connected to a first differential output;

a second differential output and a feeding arm which acts as a second differential feeding point, the feeding arm being configured to be connected to the second differential output.

43. The antenna of claim 42 further comprising a second capacitor connected between the feeding arm and the second differential output, wherein the second capacitor eliminates the need for placing a balun between the feeding arm and the second differential output.

44. The antenna of claim 42 wherein the dimension of the feeding arm can be modified to turn the frequency of the antenna.

* * * * *